US011043089B2

(12) United States Patent
Roberts et al.

(10) Patent No.: US 11,043,089 B2
(45) Date of Patent: Jun. 22, 2021

(54) SECURITY DEVICE FOR AN ELECTRICALLY POWERED DEVICE

(71) Applicants: Stephen Roberts, Gloucester (GB); Jason Butler, Gloucester (GB)

(72) Inventors: Stephen Roberts, Gloucester (GB); Jason Butler, Gloucester (GB)

( * ) Notice: Subject to any disclaimer, the term of this patent is extended or adjusted under 35 U.S.C. 154(b) by 0 days.

(21) Appl. No.: 16/647,993

(22) PCT Filed: Sep. 24, 2018

(86) PCT No.: PCT/GB2018/052704

§ 371 (c)(1),
(2) Date: Mar. 17, 2020

(87) PCT Pub. No.: WO2019/058138

PCT Pub. Date: Mar. 28, 2019

(65) Prior Publication Data

US 2020/0234549 A1 Jul. 23, 2020

(30) Foreign Application Priority Data

Sep. 22, 2017 (GB) ..... 1715422

(51) Int. Cl.
*G08B 13/14* (2006.01)
*G08B 25/10* (2006.01)

(52) U.S. Cl.
CPC ..... *G08B 13/1445* (2013.01); *G08B 13/1409* (2013.01); *G08B 13/1418* (2013.01); *G08B 25/10* (2013.01)

(58) Field of Classification Search
CPC ..... G08B 13/14; G08B 13/1409; G08B 13/1418; G08B 25/10; H02J 1/00;
(Continued)

(56) References Cited

U.S. PATENT DOCUMENTS 5,453,899 A * 9/1995 Page ..... H01R 31/065 361/1
6,536,536 B1 3/2003 Gass et al.
(Continued)

FOREIGN PATENT DOCUMENTS

DE 102016201454 A1 8/2017
EP 1204955 A1 5/2002
(Continued)

OTHER PUBLICATIONS

International Search Report and Written Opinion of International Searching Authority for International Application No. PCT/GB2018/052704, dated Dec. 20, 2018, 15 pages.
(Continued)

*Primary Examiner* — Van T Trieu
(74) *Attorney, Agent, or Firm* — Armstrong Teasdale LLP

(57) ABSTRACT

A security device for an electrically powered device includes a remote location-tracking circuit for mounting in a power plug or power cable, a control means for mounting in the power plug or power cable with the remote location-tracking circuit, an immobilizing circuit which is a power shut-down circuit for immobilizing a tool positioned within the tool casing, wherein the power shut-down circuit includes a relay; and a power cable connected between the control means and power shut-down circuit, the power cable being adapted to supply power to the tool, and the power shut-down circuit being controlled by the control means, wherein if the remote location-tracking circuit is removed by severing the power cable, thereby disconnecting the control means from the power shut-down circuit, the power shut-down circuit is configured to automatically shut down the power supply to the tool via the relay until the control means is re-connected.

15 Claims, 2 Drawing Sheets

(58) Field of Classification Search
CPC ..... H02J 1/001; H02J 13/00; H02J 13/00004; H01H 35/00
See application file for complete search history.

(56) References Cited

U.S. PATENT DOCUMENTS

| | | | | |
|---|---|---|---|---|
| 2007/0131663 | A1* | 6/2007 | Hart | F16M 13/04 219/121.78 |
| 2011/0043034 | A1* | 2/2011 | Pien | H02J 3/14 307/38 |
| 2013/0207455 | A1* | 8/2013 | Doljack | H01H 35/00 307/9.1 |
| 2014/0240125 | A1 | 8/2014 | Burch et al. | |
| 2017/0223807 | A1* | 8/2017 | Recker | H05B 47/19 |
| 2017/0288451 | A1* | 10/2017 | Trusty | H04M 1/18 |

FOREIGN PATENT DOCUMENTS

| | | | |
|---|---|---|---|
| WO | 9922277 | A1 | 5/1999 |
| WO | 0111580 | A1 | 2/2001 |
| WO | 2017133985 | A1 | 8/2017 |

OTHER PUBLICATIONS

Search Report for GB Application No. 1715422.0, dated Mar. 22, 2018, 1 page.

* cited by examiner

SECURITY DEVICE FOR AN ELECTRICALLY POWERED DEVICE

CROSS-REFERENCE TO RELATED APPLICATIONS

This application is a U.S. National Phase Application of PCT/GB2018/052704, filed Sep. 24, 2018, which claims the benefit of priority to GB Application No. 1715422.0, filed Sep. 22, 2017, the contents of which are hereby expressly incorporated by reference in their entirety.

The present invention relates to a security device for an electrically powered device and related method for protecting that electrically powered device, and in particular to a security device for a mobile device, such as an electrical tool, an item of cleaning equipment or a mobile medical device. The security device is for deterring theft and aiding recovery of one of these items, if stolen.

BACKGROUND TO THE INVENTION

Thousands of electrically powered devices or tools are stolen every year, for example, in the construction, health, and information technology industries. Tools and equipment are stolen daily from building sites, hospitals, schools, homes and vehicles. There is a high cost in replacing the stolen equipment and it is estimated that around £100 million worth of tools are stolen annually in the UK alone. Only around 5% of thefts are solved by the police with equipment being returned. These thefts have a significant detrimental cost effect across all sectors and particularly affect the finances and lives of tradesmen, who rely on their tools and equipment to provide their services.

To aid the recovery of tools, it is known from US2014/0240125 to provide a GPS tracking device positioned within the casing of a tool. The GPS device is connectable to an external device for monitoring the position of the tool. It is also known from WO2017/133985 to provide an anti-theft module including a position indication unit incorporated on a supply cable for a tool.

A problem of having this unit in the cable is that the cable can be cut off between the unit and the tool, allowing the tracking facility to be removed from the tool altogether. The cable can then be replaced by the thief and the tool utilised as normal.

It is also known from U.S. Pat. No. 6,536,536 to provide a disabling device within a tool, which can be controlled by a user. For example, there may be a user input in the form of a pre-determined pattern input that is not readily apparent from examination of the power tool. A disadvantage of this is that the user has to activate the tool for use, and also remember the necessary code. This becomes more difficult if there are multiple tools with different codes, unless using the same code for many tools, which is riskier.

It is an object of the present invention to provide an improved security device for electrically powered devices which reduces or substantially obviates the above-mentioned problem.

SUMMARY OF THE INVENTION

According to a first aspect of the present invention, there is provided a security device for an electrically powered device comprising:

- a remote tracking circuit for mounting in a power plug or supply cable,

- a control means for mounting in the power plug or supply cable,
- a power shut-down circuit for immobilising a tool and positioning within the tool casing;
- and a power cable connected between the control means and power shut down circuit, the power cable being adapted to supply power to the tool, and the power shut-down circuit being controlled by the control means, the power shut-down circuit being configured to automatically shut down the power supply to the tool until the control means is reconnected, if the cable is severed.

Optional features are provided in the dependent claims.

The invention effectively provides a smart lead, which enables both location tracking and immobilisation of a device. If the tracking circuit (or tracker) is forcibly removed by cutting the cable, then the electrically powered device is immobilised and cannot be used by simply reconnecting a new cable. The power shut-down circuit (or immobilisation circuit) is provided 'tool-side', for example within a tool casing. This makes it difficult to tamper with the power shut-down circuit without damaging the tool. The remote tracking circuit is provided 'plug-side', for example in a plug or as part of a power supply cable. The control means is also provided plug-side, with the remote tracking circuit.

The security device may include a mobile SIM circuit or other remote communication means. This may allow remote connection to a web portal, enabling remote immobilisation of the electrically-powered device by the control means at any time, if still connected. In other words, if the electrically powered device is stolen, then it is rendered useless by immobilisation and can also be tracked until such time as the thief successfully removes the remote tracking circuit.

The security device can be fitted during the manufacture of a new tool or electrical device, for example. The security device can also be retro-fitted to existing tools or devices.

The remote tracking circuit may be a GPS tracking circuit, for example. Other equivalent systems such as GLONASS may be used instead.

The control means and remote tracking circuit may be mounted in a power plug attached to the power cable. This allows the power cable to be reeled up easily for storage, for example.

Alternatively, the control means and remote tracking circuit may be mounted partway along a power supply cable. In this way, a standard 3-core cable AC supply and plug may connect to the control means. In some cases, a standard 2-core cable (without an earth) may be used to connect to the control means, if the relevant product is double insulated or has no external parts or housing which could be conducting.

The power cable between the control means and power shut down circuit is preferably a 5-core cable. The 5-core cable may include an earth, live and neutral core for powering the tool, and DC positive and negative cores for powering a shut-off relay.

Using a 5-core cable means that, if the cable is cut, it is much more difficult to re-wire it for further use. The individual cores need to be correctly identified, and also each core wired to a replacement plug portion. This involves significantly more effort than existing systems, and so provides a much higher deterrent to theft.

The control means and power shut-down circuit may be a complementary pair. The power shut-down circuit may be configured to automatically shut down the power supply to the tool unless the control means provides a valid authentication token. In other words, the power shut-down circuit may include means for verifying or authenticating that the original control means is still connected to the power shut-down circuit. The power shut-down circuit may prevent power from being supplied to the tool until a valid code or token is received from the control means. The control means may be programmed with a code specific to the power shut-down circuit. Thus the tool may only work when the paired control means and power shut-down circuit are together. Therefore, a different plug cannot be attached in place of the original plug because it would not provide the correct code or token to power the tool. This means that the plug or cable for a tool corresponds only to that tool, and makes it harder to re-wire it for illicit use.

A physical token such as a chip may be used in addition or as an alternative, so that the power shut-down circuit is engaged to disable the tool when the token is not connected.

The control means may include a battery for powering the remote tracking circuit.

This allows the tracking circuit to remain active for up to several weeks. The frequency and duration of remote communication with the tracking circuit will affect the actual length of time until the battery is drained.

The device may further comprise a battery charging circuit for charging the battery when the device is connected to a power supply. This means that, if the battery has been fully drained, the tracking circuit is re-activated and the battery charged as soon as the device is plugged into the mains.

The control means may be configured to initiate the power shut-down circuit on receipt of a wirelessly-transmitted shut-down signal for remotely immobilising the tool. This provides a software-based means for immobilising the tool, in addition to the hardware-based immobilisation features. The software-based immobilisation feature may be used without the hardware-based immobilisation feature in some cases.

The control means may also be configured to 'reset' the tool to a useable state if the tool is recovered following immobilisation. This may also be done remotely. For example, a web-based system or portal may be provided to remotely connect to and control one or more elements of the device.

The web-based portal can be used to set a custom 'geofenced' area or perimeter. This includes setting a home location for the tool (or other device), i.e. where it is expected to be stored or used. It also includes setting a maximum distance from that location, or a perimeter around the location. If the tool moves outside the predetermined area, then an alarm is raised. This can include one or more of: an alert on the web-based system, an alert sent to a remote device (or devices) when such details are provided in the system, and/or an alert from the security device itself.

Sending an alert to other devices (e.g. mobile phones) can allow a quick response by the owner or a security team, for example. This cuts out the delay between theft of the tool and the realisation that it has been stolen, which in turn maximises the chances that the tool can be successfully recovered.

If the security device emits an alert, this may be an audible alert from a buzzer or speaker, for example. This provides a way of finding the tool quickly when nearby, since at close range the remote tracking circuit may not provide the most effective way of locating the tool.

The controls means may be configure to detect when the power cable is cut. The control means may be configured to send an alert to a remote system and/or device(s) when the detection circuit detects that the power cable has been cut. If the cable is cut at the moment of theft, then tracking and recovery of the tool can begin straightaway. This avoids a delay in beginning recovery of the tool. This is particularly useful if a relatively large geofenced area has been set, for example.

A cable for a tool or electrically powered device may be provided which comprises the security device. In this case, the power shut-down circuit is disposed at or near the end of the cable which is to be mounted within the tool casing.

A tool or electrically powered device may be provided which comprises the security device. The tool may be a drill. The drill may include a casing, a power supply cable and a plug, in which the remote tracking means and control means are mounted in the plug or power supply cable, and the power shut-down circuit is mounted within the casing and connected to the control means via the power cable.

According to a second aspect of the invention, there is provided a method of protecting a tool or electrically-powered device, the method comprising the steps of:

a) providing a remote tracking circuit and a control means in a power plug or supply cable of the tool, the power cable being adapted to supply power to the tool, b) providing a power shut-down circuit in the power supply cable, and positioning the power shut-down circuit within the casing of the tool for immobilising the tool, the power shut-down circuit being connected to and controlled by the control means, and the power shut-down circuit being configured to automatically shut down the power supply to the tool until the control means is re-connected, if the cable is severed.

The method may include any feature or combination of features presented with respect to the first aspect of the invention.

DESCRIPTION OF THE DRAWINGS

For a better understanding of the present invention, and to show more clearly how it may be carried into effect, a preferred embodiment will now be described with reference to the attached drawings, in which.

DETAILED DESCRIPTION OF THE PREFERRED EMBODIMENT

Figure 1:
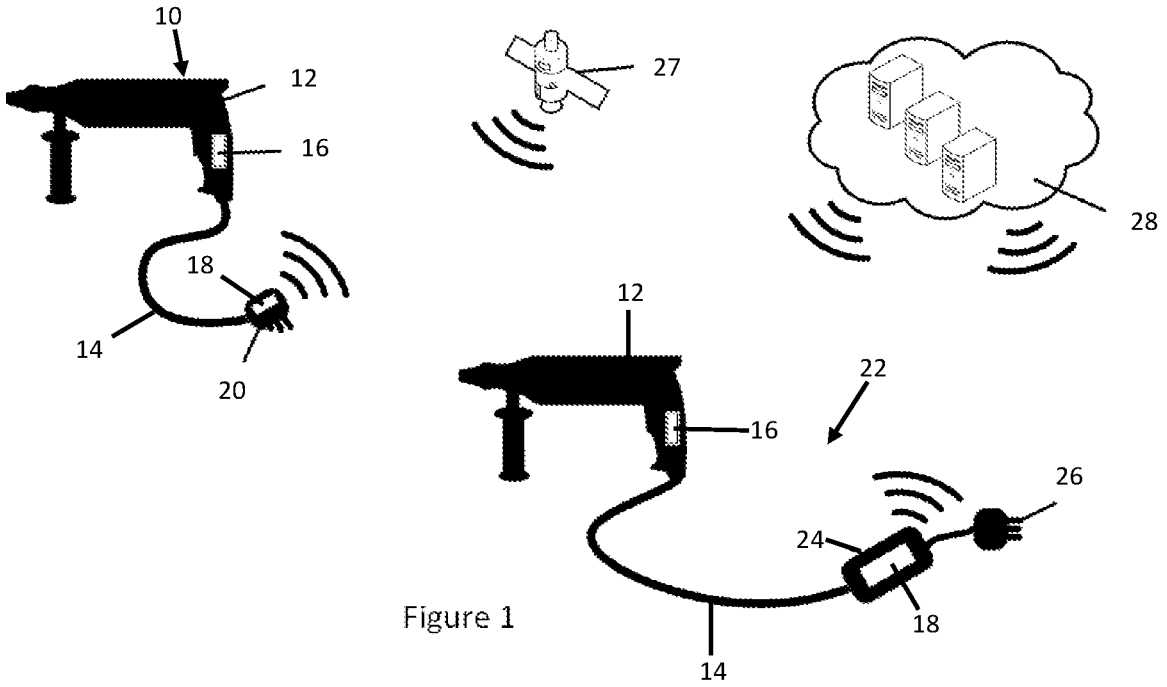
FIG. 1 is a schematic view of the security device of the invention in a first embodiment with the control means in a plug and a second embodiment with the control means set into a power supply cable; in use on a power drill, being satellite tracked and being monitored by a computer network.

Referring firstly to FIG. 1, a first embodiment of a security device of the invention is indicated generally at 10. The security device 10 is shown connected, by way of example, to a power drill 12, although it could be connected to any mobile tool or appliance utilising a power supply cable 14 including live, neutral and earth connections.

An immobilising circuit, or power shut down circuit, 16 is built into the tool 12. A control means 18 for controlling the power shut down circuit 16 is mounted in a plug 20, in this case a fused 3-pin plug.

An alternative second embodiment is generally indicated at 22. In this embodiment, the immobilising circuit, or power shut down circuit, 16 is again built into the tool 12. However, the control means 18 for controlling the power shut down circuit 16 is mounted in a housing 24 set into the cable 14. The cable extends from the housing 24 to a plug 26, in this case a conventional fused 3-pin plug. It will be appreciated that the type of plug can vary depending on country.

A GPS tracking circuit is provided as part of the control means 18, enabling the device to be tracked by satellite services 27 and monitored by a computer portal 28.

Figure 2:
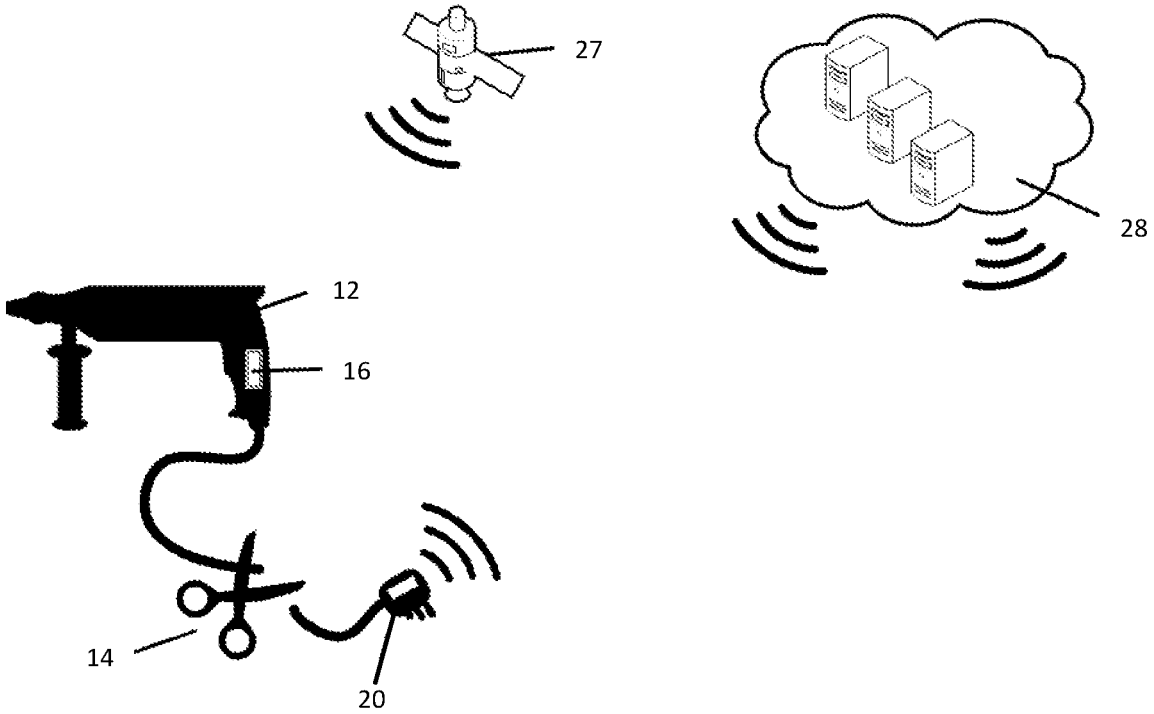
FIG. 2 is a schematic view of the second embodiment of security device of FIG. 1 with the power supply cable being cut.

Referring to FIG. 2, the cable 14 of the first embodiment is cut. In other words, the cable 14 between the control means and power shut down circuit components is severed and the power supply to the tool 12 is immediately cut off by the power shut down circuit. In other words, the tool 12 is disabled. The GPS tracking circuit will continue to operate even when the cable 14 has been cut. The operation of the security device will be described further below.

Figure 3:
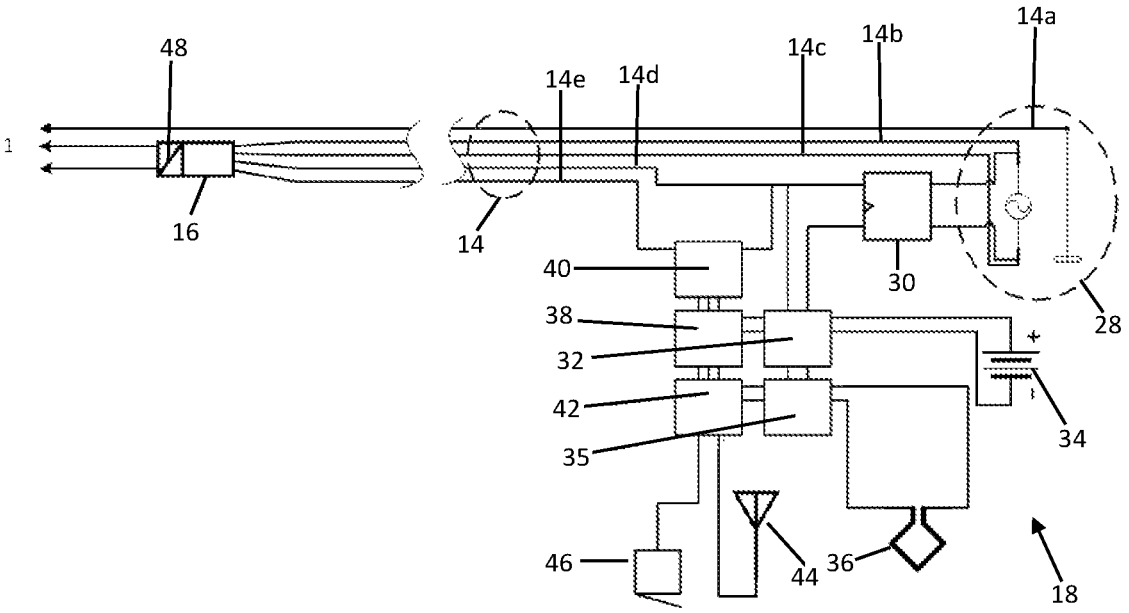
FIG. 3 is schematic high-level view of the electrical circuit of the security device.

Referring now to FIG. 3, the supply cable 14 from the control means 18 is a 5-core cable. As indicated in dotted outline at 28, a standard AC supply is connected to the control means. The 5-core cable 14 includes an earth 14*a*, live 14*b* and neutral 14*c*.

To power the control means 18, the power is passed to an AC/DC convertor 30, for example, a buck AC/DC transformer or similar power reduction circuit. Power from the convertor 30 passes to a number of integrated circuits including a battery charging circuit 32, which is connected to a battery 34. Power also passes to a GPS tracking circuit 34 with associated antenna 36, a central processing unit (or microprocessor) 38, immobilisation circuit 40 for remotely immobilising the tool, and mobile SIM circuit 42, also connected to an antenna 44, i.e. enabling GSM connection with the ability to send and receive data and SMS messages. The remote connection for data is GPRS or above (including 3G/LTE). Optionally, a speaker or buzzer 46 is provided to provide an audible alert.

The 5-core cable further includes DC positive and negative cores 14*d*, 14*e*, which control a relay 48 in the power shut down circuit 16. The relay 48 is effectively a switch in the live supply 14*b* to the tool 12. The relay 48 is held within the casing of the tool and so is not easily removed or tampered with.

The power shut-down circuit 16 and/or relay may be adapted to require a valid code or token in order to close the relay 48 to power the tool 12. This may be a physical token or key (not shown) which is engageable in the tool to close the relay 48. The token or key is preferably unique to that specific tool 12. It may also be a token or key provided by the CPU 38. The token is specific to the particular power shut-down circuit 16 and CPU pair. Therefore, using a replacement plug with the tool 12 would only power the tool if the CPU was programmed with the correct token or key.

In operation, the battery charging circuit 32, which includes a secondary step-down circuit, powers the GPS tracker circuit 35 and battery charging circuit 32. The battery enables location and portal connection services for a few weeks when charged. The longevity of the service depends on tracking frequency, which can be set at the portal 28 or by the user.

The tracker will sleep, then wake at set periods, this will then activate the GPS and locate the current coordinates, then use the GPRS functionality to send an encrypted information packet to the central portal server via a custom-built REST (Representational State Transfer) API (Application Programming Interface). It will be protected with encryption keys known only by the system, which protects data both at rest and in-flight. The frequency with which the tracker wakes/sleeps can be set remotely via the portal.

When the security device or smart lead connects to the portal 28, it can also be triggered to download a small amount of information, such as the frequency of tracking, updates and also an immobilisation trigger—which will activate the immobiliser. If the cable has been cut, the GPS tracking circuit still sends data to the portal when it is active. Periodic communication with the portal means that the last known location of the tool is immediately available if the device is stolen or lost. The portal can then be used to enable periodic or continuous tracking of the device until the battery is depleted.

When the tool 12 is plugged in, then the battery 34 is charged. The battery charging circuit 32 charges the battery when connected to a power supply, such as a mains supply. In the event of a tool being stolen, this means that the battery should have a full or near-full charge, to maximise the length of time the tool can be remotely tracked.

The 5-core cable 14 makes it more difficult for an opportunistic thief to re-wire the cable once the tracker has been cut-off. The thief will need to identify the 2 DC control cores 14*d*, 14*e* and power up the relay to reconnect the live power supply 14*b*. For an opportunist thief, there is little chance of the tool 12 being powered up, once the control means 18 is cut off.

When the control means 18 is built into the plug housing 20, the casing has been designed in such a way that it can cater for UK Plugs, European Plugs and Commando Plugs, thus maximising its compatibility and usage. This also allows for simplified manufacture, and cost reduction.

In summary, the present invention provides a security device which enables both remote tracking and immobilisation of a tool (or other electrical device) fitted with the security device. Removing the plug effectively causes the tool to become permanently disabled, so there is limited value for an opportunistic thief to steal a tool fitted with the security device. If the plug is left in place, the tool can be tracked and can also be remotely immobilised. The security device provides a very cost-effective way to deter theft of tools and other electrical devices.

It will be apparent that various modifications may be made to the embodiment disclosed, which is only an example. The invention is defined in the claims.

The invention claimed is:

1. A security device for an electrically powered device comprising:

a remote location-tracking circuit for mounting in a power plug or power cable;

a control means for mounting in the power plug or power cable with the remote location-tracking circuit;

an immobilizing circuit which is a power shut-down circuit for immobilizing a tool positioned within the tool casing, wherein the power shut-down circuit includes a relay; and the power cable connected between the control means and power shut-down circuit, the power cable being adapted to supply power to the tool, and the power shut-down circuit being controlled by the control means, wherein if the remote location-tracking circuit is removed by severing the power cable, thereby disconnecting the control means from the power shut-down circuit, the power shut-down circuit is configured to automatically shut down the power supply to the tool via the relay until the control means is re-connected.

2. A security device as claimed in claim 1, in which the remote location-tracking circuit includes a mobile SIM circuit.

3. A security device as claimed in claim 1, in which the control means and remote location-tracking circuit are mounted in a power plug attached to the power cable.

4. A security device as claimed in claim 1, in which the control means and remote location-tracking circuit are mounted partway along the power cable.

5. A security device as claimed in claim 1, in which the power cable between the control means and power shut-down circuit is a 5-core cable.

6. A security device as claimed in claim 5, in which the 5-core cable includes earth, live and neutral cores for powering the tool, and DC positive and negative cores for powering the relay of the power shut-down circuit.

7. A security device as claimed in claim 1, in which the control means and power shut-down circuit are a complementary pair, the power shut-down circuit being configured to automatically shut down the power supply to the tool via the relay unless the control means provides a valid authentication token.

8. A security device as claimed in claim 1, in which the control means includes a battery for powering the remote location-tracking circuit.

9. A security device as claimed in claim 8, in which the device further comprises a battery charging circuit for charging the battery when the device is connected to a power supply.

10. A security device as claimed in claim 1, in which the control means is configured to initiate the relay in the power shut-down circuit on receipt by the control means of a wirelessly-transmitted shut-down signal for remotely immobilizing the tool.

11. A security device as claimed in claim 1, in which the control means is configured to detect when the power cable is cut and send an alert to a remote system and/or device(s).

12. A cable for a tool or electrically powered device comprising a security device as claimed in claim 1.

13. A tool or electrically powered device comprising a security device as claimed in claim 1.

14. A tool or electrically powered device as claimed in claim 13, in which the tool is a drill including a casing, a power cable and a plug, the remote location-tracking circuit and control means being mounted in the plug or power cable, and the power shut-down circuit being mounted within the casing.

15. A method of protecting a tool or electrically-powered device, the method comprising the steps of:

a) providing a remote location-tracking circuit and a control means in a power plug or power cable of the tool or electrically-powered device, the power cable being adapted to supply power to the tool or electrically-powered device; and b) providing a power shut-down circuit including a relay in the power cable, and positioning the power shut-down circuit within the casing of the tool or electrically-powered device for immobilizing the tool or electrically-powered device, the power shut-down circuit being connected to and controlled by the control means, wherein if the remote location-tracking circuit is removed by severing the power cable, thereby disconnecting the control means from the power shut-down circuit, the power shut down circuit is configured to automatically shut down the power supply to the tool or electrically-powered device via the relay until the control means is re-connected.

* * * * *